United States Patent [19]

Marti et al.

[11] 3,977,579

[45] Aug. 31, 1976

[54] APPARATUS FOR ADJUSTING THE OPERATING POSITION OF CASTING VESSELS DURING THE CONTINUOUS CASTING OF STEEL

[75] Inventors: Heinrich Marti, Forch, Switzerland; Jacques Barbe', Saint Etienne, France; Pierre Gay, l'Etrat, France; Raymond Vial, Lorette, France

[73] Assignee: Concast AG, Zurich, Switzerland

[22] Filed: Apr. 28, 1975

[21] Appl. No.: 572,268

[30] Foreign Application Priority Data

May 10, 1974 Switzerland ..... 6394/74

[52] U.S. Cl. ..... 222/591; 164/136

[51] Int. Cl.[2] ..... B22D 41/00

[58] Field of Search ..... 222/166, 168.5, 168, 222/DIG. 15, DIG. 23, 591, 607; 164/136, 281

[56] References Cited

UNITED STATES PATENTS

| | | | |
|---|---|---|---|
| 3,773,228 | 11/1973 | Koch et al. | 164/281 X |
| 3,894,576 | 7/1975 | Schoffmann | 222/168 X |

FOREIGN PATENTS OR APPLICATIONS

| | | | |
|---|---|---|---|
| 1,964,231 | 7/1971 | Germany | 164/281 |
| 969,308 | 9/1964 | United Kingdom | 164/281 |

*Primary Examiner*—Robert B. Reeves
*Assistant Examiner*—David A. Scherbel
*Attorney, Agent, or Firm*—Werner W. Kleeman

[57] ABSTRACT

An apparatus for adjusting the operating position of casting vessels during the continuous casting of metals, especially steel, the casting vessels being arranged at a pivotable transport mechanism. There is provided a drive for pivoting such transport mechanism and a locking device for the operating position. The locking device embodies mechanism for adjusting the casting vessel in different operating positions.

5 Claims, 2 Drawing Figures

APPARATUS FOR ADJUSTING THE OPERATING POSITION OF CASTING VESSELS DURING THE CONTINUOUS CASTING OF STEEL

BACKGROUND OF THE INVENTION

The present invention relates to a new and improved construction of apparatus for adjusting the operating position of casting vessels during continuous casting of metals, typically steel, the casting vessels being arranged at a pivotable transport mechanism, there being provided a drive for rocking or pivoting such transport mechanism and a locking device for fixing the operating position of the casting vessel.

During the continuous casting of steel it is known to those versed in the art to bring casting vessels, such as for instance pouring ladles and/or tundishes into the casting position by means of a pivotable transport mechanism or device. For the purpose of transporting casting ladles there are employed, among other things, ladle swing towers having support arms mounted and supported along an axis of rotation. The support arms are equipped with a drive mechanism enabling the rocking or pivoting of the arms about the axis of rotation. The casting ladles thus can be mounted in the support arms externally of the servicing or operating region and can be brought into casting position by rocking the aforementioned arms. The drive mechanism cooperates with a rotary track or rim arranged at the pivotal portion of the swing tower. According to a state-of-the-art system employing independently pivotal arms, when one of the support arms assumes the operating position it is blocked by means of a position locking device in the form of a locking pawl engaging with a recess provided at the rotary track or rim. As a result, there is prevented any movement of the casting or pouring ladle out of its casting position. With the aid of the aforementioned pawl there is simultaneously fixed the operating position of the pouring or casting vessel and the support arm. However, it was not possible to achieve an exact positioning by means of the rotary drive.

Upon mounting the casting ladles at the support arms there oftentimes occur considerable jarring forces and impacts upon the relevant support arm at which the casting vessel is mounted. These jarring forces and impacts are transmitted to the locking pawl in the case of swing towers with rigidly connected support arms and thus can lead to destruction or damage of the locking pawl. When this happens it is possible that the locking pawl no longer can be disengaged and hence rocking of the support arm with the ladle out of the casting position is equally no longer possible, which in turn can lead to disturbances and considerable downtimes in the operation of the continuous casting plant.

If the ladle is inaccurately mounted in the support arm and then rocked into the casting position, then the casting or pouring opening of the ladle is not at the desired location above the tundish. Owing to the fixed engagement of the aforementioned locking pawl of the prior art system it is not possible to correct this fault. In the case of sequential pours there additionally arises the so-called formation of skull in the tundish since the pouring or outlet opening of the ladle is always located at the same place. This formation of skull can intensively disturb the casting operation. Additionally, due to the flow of the influent steel the impact location in the tundish is eroded, thus reducing its longevity.

SUMMARY OF THE INVENTION

Hence, with the foregoing in mind it is a primary object of the present invention to provide an improved construction of apparatus for adjusting the operating position of casting vessels during the continuous casting of metals which is not associated with the aforementioned drawbacks and limitations of the prior art proposals.

Another and more specific object of this invention is to provide an improved construction of apparatus permitting of an exact adjustment of a casting vessel in its operating position as well as allowing for a change in the position of the pour-in location in the tundish during sequential pours.

Now in order to implement these and still further objects of the invention, which will become more readily apparent as the description proceeds, the invention contemplates that the locking device is equipped with a mechanism for adjusting a casting vessel in different operating positions.

By means of this adjusting or adjustment mechanism the casting vessels can be brought into the different desired operating positions. When necessary its casting position can be changed during the casting operation, thereby preventing the formation of skull as well as the damaging erosion of the impact location of the steel jet in the tundish. Moreover, considerably lesser demands are placed upon the rotary drive of the pivotable transport mechanism or device, resulting in a reduction of the costs of the plant or installation.

According to an advantageous feature of the invention the drive for pivoting the transport mechanism can be uncoupled from the transport mechanism. In this way the transmission or gearing can be protected against impacts as soon as the casting vessel is approximately located in the casting position. The fine adjustment is undertaken by means of the additional adjustment mechanism.

According to a further facet of the invention the position locking device consists of two clamping arms which are pivotably mounted at the stationary portion of the transport mechanism or at a frame of the installation and both clamping arms are provided with power means for exerting a desired opening and closing force at the clamping arms. The adjustment mechanism or means of the position locking device embodies a rotatable eccentric disk or roll arranged between the clamping arms for achieving the fine adjustment. When the clamping arms assume their closed position they engage about this eccentric disk or roll and a pin or journal which is attached at the rotatable portion of the transport mechanism or at the casting vessel. Owing to this special design of the position locking device and the adjustment mechanism it is possible to effectively take-up forces, such as impact or jarring forces, for instance brought about when mounting a new ladle at the support arm located outside of the operating position, by earthquakes and so forth.

BRIEF DESCRIPTION OF THE DRAWING

The invention will be better understood and objects other than those set forth above, will become apparent when consideration is given to the following detailed description thereof. Such description makes reference to the annexed drawing wherein.

DETAILED DESCRIPTION OF THE INVENTION

Figure 1:
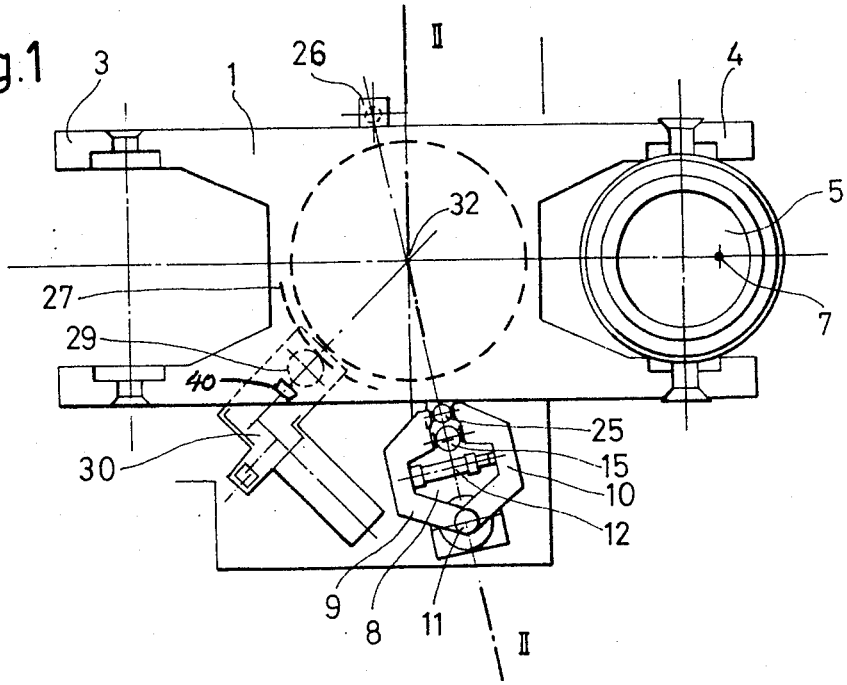
FIG. 1 is a plan view of a pivotable transport mechanism for casting ladles together with the drive gearing and adjustment mechanism.

Describing now the drawing, it is to be understood that for the purpose of simplifying the showing of the drawing only enough of the continuous casting plant to which the inventive aspects pertain has been shown so that those skilled in the art will readily understand the underlying concepts of the invention. Turning attention specifically to FIG. 1 there is depicted a pivotable transport mechanism or device 1 which is here shown, by way of example, as a ladle swing tower, the pivotable portion of which consists of two rigidly interconnected ladle support arms 3 and 4. The ladle swing tower also includes a stationary portion 2 which is supported at the floor of the continuous casting plant. In the showing of FIG. 1 a ladle 5 is mounted in the support arm 4 which is located in the casting or operating position. This ladle 5 possesses a pouring or outlet opening 7 which is supposed to assume a certain operating position in relation to a subsequently arranged conventional tundish which has not been particularly shown in the drawing. In order to maintain this position there is provided a position locking device or mechanism 8 which cooperates with a positioning pin or journal 25 here shown attached to the support arm 4. In order to position a casting or pouring ladle in the support arm 3 there is provided a positioning pin or journal 26.

According to the showing of FIG. 1 the support arm 3 is illustrated in a preparatory position in which the empty ladle is to be exchanged for a full ladle, for instance with the aid of a crane of the like, all of which is well known to those skilled in this art. A drive gearing or transmission 30, constituting drive means, is here shown attached to the installation frame 6, drive gearing 30 engaging with a toothed rim or track 27 through the agency of a drive gear 29 or the like. The toothed rim 27 is connected at the pivotal part of the ladle swing tower 1. By means of this drive 30 the pivotal part of the swing tower incorporating the support arms and thus the full casting or pouring vessel can be rocked into the casting position. The drive gear 29 can be disconnected by means of the schematically illustrated coupling 40 from the remainder of the drive 30, and thus it will be appreciated the drive 30 is uncoupled from the transport mechanism 1. As soon as the support arm 4 together with the casting vessel or ladle 5 is located at the region of the operating position then the drive 30 is uncoupled. At this time the pouring or outlet opening 7 of the casting ladle 5 is generally not in the desired operating position since the drive 30 normally only provides an inaccurate or initial positioning which must be further finely adjusted. The exact or fine adjustment of the operating position is undertaken with the aid of the position locking device 8.

Continuing, this position locking device 8 consists of the clamping arms 9 and 10 which are pivotably arranged in a bearing arrangement 11 and a power unit 12 which is operatively connected with the clamping arms 9 and 10. The power unit or force-applying unit 12 may be constituted by a plunger arrangement or a piston cylinder arrangement operatively connected with the clamping or clamp arms 9 and 10. The bearing arrangement 11 is arranged at a support 13 connected with the installation frame 6, as best seen by referring to FIG. 2. Operatively associated with the position locking device 8 is an adjustment mechanism or means 22. Such embodies an eccentric roller or disk 15 equipped with the shaft 16, a bearing arrangement 18, a coupling 21 and a drive arrangement 20. The bearing arrangement 18 is connected via the support or brace 19 with the installation frame 6. In the embodiment under discussion the drive 20 rotating the eccentric roller or disk 15 is likewise attached to the frame 6.

Figure 2:
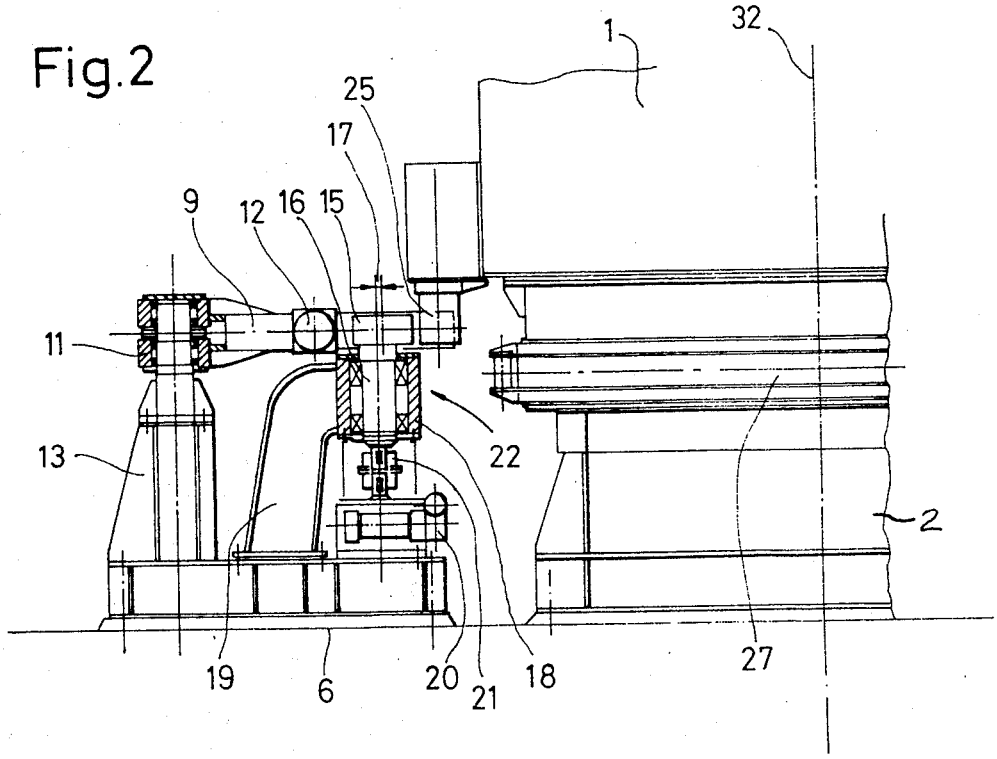
FIG. 2 is a partial sectional view of the arrangement of FIG. 1, taken substantially along the line II—II thereof.

Now in FIG. 2 there is illustrated a partial sectional view through the locking device 8 and the adjustment mechanism 22, the function of which will be considered more fully hereinafter. During the rocking or pivotal movement of the support arms of the swing tower 1 the clamping arms 9 and 10 are in their open position. The clamping arms 9 and 10 are spread apart to such an extent that the positioning pin 25 is not hindered when moving along its displacement path. As soon as the casting ladle 5 is approximately located in the operating position, then the rotational movement of the support arms 3 and 4 is interrupted. During the uncoupling of the drive gearing 30 the clamping arms 9 and 10 are urged towards one another into their closed position by means of the power unit 12, so that the clamping arms now engage about the eccentric disk 15 and the positioning pin 25. The exact closing position of the clamping arms 9 and 10 is thus determined by the eccentric disk 15 and the bearing arrangement 11 of both arms 9 and 10. The correct closed position of the clamping arms 9 and 10 and the correct operating position of the ladle 5 is then attained when the axes of the bearing arrangement 11, the eccentric disk 15 and the positioning pin 25 are located along a straight line, as the same has been shown for instance in FIG. 1. If, however, the casting ladle is not in the desired effective operating position, then by rotating the eccentric disk 15 by means of the drive 20 it is possible to adjust this position of the ladle 5.

In the exemplary embodiment under discussion the axis of the eccentric disk 15 in relation to the axis of the shaft 16 possesses an eccentricity 17 of 40 millimeters. By rotating the eccentric disk 15 it is possible to attain a change in the position of the pouring or outlet opening 7 through 200 millimeters. This adjustment range allows for the desired positioning of the ladle 5 and the pouring opening 7, preventing the formation of skull in the tundish. If a larger or smaller adjustment range is desired, then such can be realized by changing the eccentricity 17 of the disk 15 or by changing the spacing of such eccentric disk 15 and the pouring opening 7 from the axis of rotation 32 of the ladle swing tower 1.

The entire locking device 8 is constructed to be sufficiently robust that it can take up jarring forces transmitted via the frame 6 to the swing tower or impact loads of forces arising in consequence of manipulations undertaken at the support arm 3 located in the preparatory position. In this way there is prevented that the casting or pouring ladle 5 is shifted out of the operating position and damage to important components of the installation.

In the case of ladle swing towers of the type where the support arms 3 and 4 are not connected with one another, rather individually mounted and pivotable, then it is to be appreciated that for each support arm 3 and 4 there must then be provided the locking and adjustment mechanisms discussed above. By the same token there must also be provided two drives 30.

While there is shown and described present preferred embodiments of the invention, it is to be distinctly understood that the invention is not limited thereto, but may be otherwise variously embodied and practiced within the scope of the following claims.

Accordingly, what is claimed is:

1. An apparatus for adjusting the operating position of a casting ladle cooperating with a tundish during the continuous casting of metals, especially steel, comprising a pivotal transport mechanism pivotal about a vertical axis for the transport of the casting ladle from a preparatory position into an initial operating position for the casting of the metal, drive means for pivoting said transport mechanism, a locking device for positionally fixing the initial operating position of the casting vessel, said locking device being provided with means for adjusting the casting ladle into different effective operating teeming positions within a desired location above the tundish.

2. The apparatus as defined in claim 1, further including means for operatively disengaging said drive means from said transport mechanism.

3. An apparatus for adjusting the operating position of casting vessels during the continuous casting of metals, especially steel, comprising a pivotal transport mechanism for the transport of a casting vessel from a preparatory position into an operating position for the casting of the metal, drive means for pivoting said transport mechanism, a locking device for positionally fixing the operating position of the casting vessel, said locking device being provided with means for adjusting the casting vessel into different operating positions, said locking device comprises two clamping arms, means for pivotably mounting said clamping arms for movement between an open position and a closed position, power means operatively connected with said pivotable clamping arms for selectively opening and closing said clamping arms, said adjusting means including an eccentric disk arranged between said clamping arms, said transport mechanism including a pivotal component, a positioning pin carried by said pivotal component of said transport mechanism, said clamping arms when assuming their closed position engaging about said eccentric disk and said positioning pin.

4. The apparatus as defined in claim 3, further including means for rotatably mounting said eccentric disk, and drive means cooperating with said mounting means for said eccentric disk for selectively rotating said eccentric disk for finely adjusting the casting vessel into the different operating positions.

5. The apparatus as defined in claim 4, further including frame means, said means for pivotably mounting said clamping arms being supported by said frame means.

* * * * *